US006134712A

United States Patent [19]

Spector

[11] Patent Number: 6,134,712

[45] **Date of Patent: *Oct. 24, 2000**

[54] INTEGRATED BACKPACK AND RAINCOAT ASSEMBLY

[76] Inventor: Donald Spector, 38 Mountain Rd., Union City, N.J. 07080

[ * ] Notice: Under 35 U.S.C. 154(b), the term of this patent shall be extended for 47 days.

[21] Appl. No.: 08/712,887

[22] Filed: Sep. 12, 1996

[51] Int. Cl.[7] ..... A41D 1/00; A45F 4/00

[52] U.S. Cl. ..... 2/94; 224/577

[58] Field of Search ..... 2/94; 224/153, 224/575, 577

[56] References Cited

U.S. PATENT DOCUMENTS

| | | | |
|---|---|---|---|
| 4,389,735 | 6/1983 | McLaughlin | 2/94 |
| 4,563,777 | 1/1986 | Park | 2/94 X |
| 4,689,831 | 9/1987 | Greenberger et al. | 2/94 X |
| 5,165,111 | 11/1992 | Lieberman | 2/94 |
| 5,407,112 | 4/1995 | Christodoulou et al. | 2/94 X |
| 5,526,969 | 6/1996 | Greenberger | 2/94 X |

*Primary Examiner*—John J. Calvert
*Assistant Examiner*—Shirra L. Jenkins

[57] ABSTRACT

An integrated assembly formed by a backpack that includes a bag having a front section to which shoulder straps are attached to form loops adapted to receive the arms of a wearer, and a raincoat having a rear panel whose upper section is joined to the front section of the bag, a separable front panel to permit the wearer to don the raincoat, and a pair of sleeves. In the passive mode of the assembly, the raincoat is folded to form a flat compact that lies against the front section of the bag and is joined thereto, the compact then being adjacent the back of the wearer of the backpack. In the active mode of the assembly, the compact is unfolded so that the raincoat then depends from the front section of the bag, the sleeves of the compact then being extended through the loops whereby when the wearer dons the raincoat and inserts his arms through the sleeves, the backpack is then carried over the raincoat.

6 Claims, 2 Drawing Sheets

FIG. 1
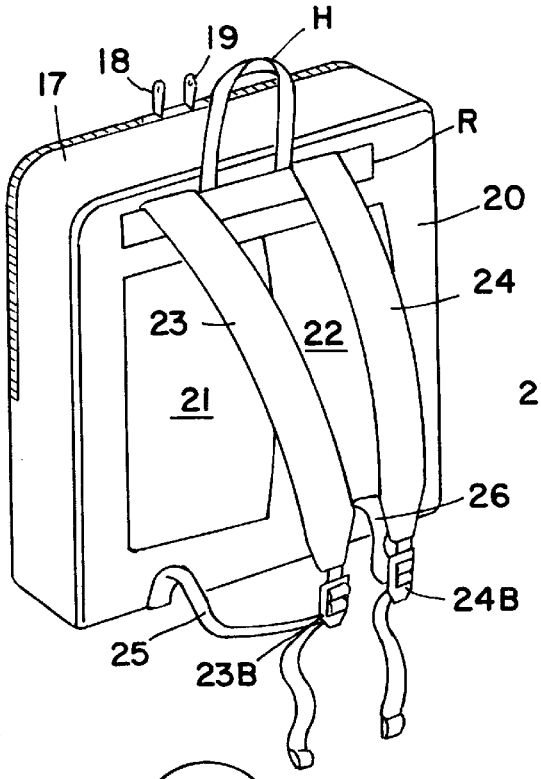
FIG. 2
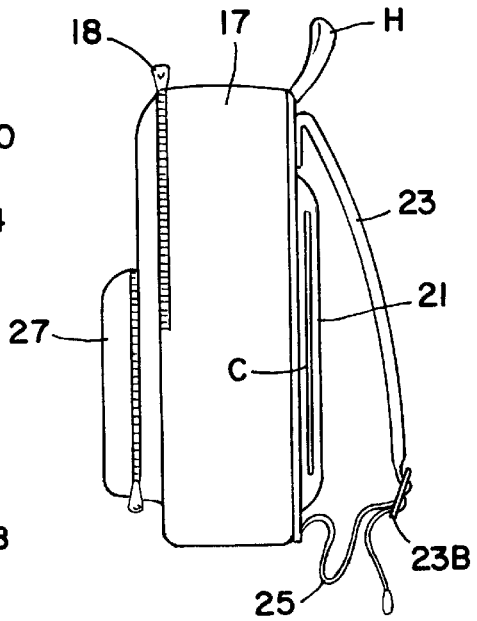
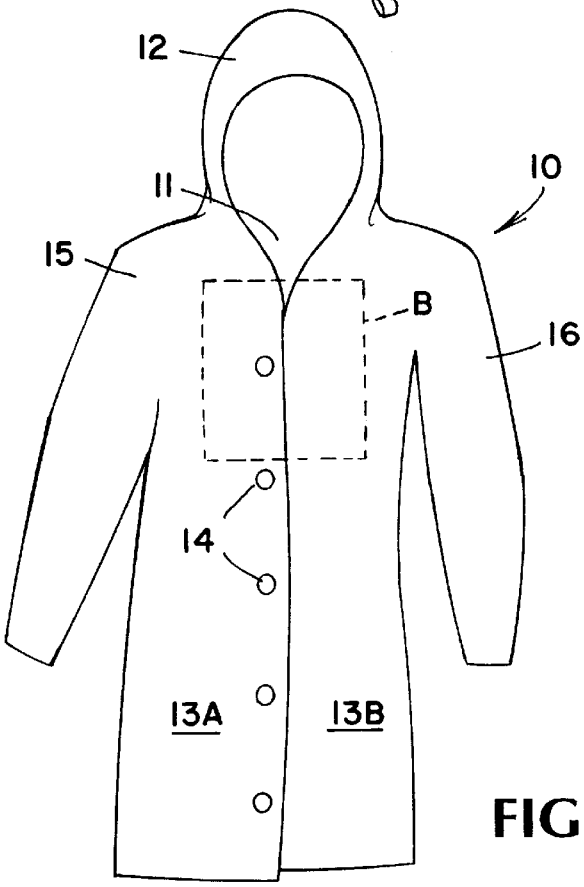
FIG. 3
FIG. 4
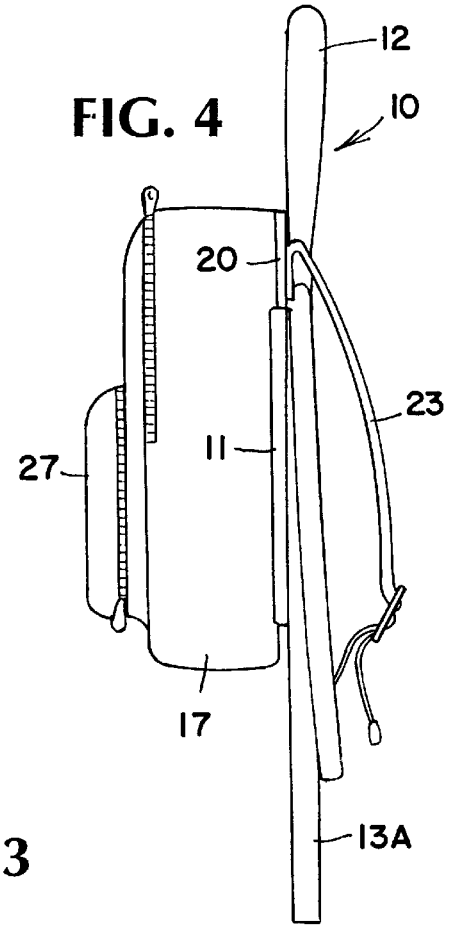

INTEGRATED BACKPACK AND RAINCOAT ASSEMBLY

BACKGROUND OF THE INVENTION

1. Field of Invention

This invention relates generally to backpacks having shoulder straps forming loops to support the backpack on the back of the wearer, and more particularly to an assembly in which a raincoat having sleeves is integrated with the backpack whereby in a passive mode of the assembly, the raincoat is folded into a flat compact that is joined to the bag of the backpack and lies adjacent the back of the wearer, and in an active mode in which the raincoat is unfolded and its sleeves are extended through the loops, then when the wearer dons the raincoat, the backpack is carried over the raincoat.

2. Status of Prior Art

A backpack, also called a knapsack, is a pouch or bag provided with shoulder straps to form loops for supporting the bag on the back of the wearer. While backpacks were originally intended for use by soldiers and hikers, they are now in much more widespread use. Thus it is now common practice for students and members of what is now referred to as Generation X to carry books and other articles in a backpack rather than in a briefcase or other hand carried bags or pouches, thereby leaving the hands free. A typical backpack is provided with an expandible bag or pouch having a large load capacity.

Since a wearer of a backpack may in the course of a trip encounter inclement weather, it is common practice for the wearer to take along a raincoat of a type that can be easily folded so that it can be stored in the bag of the backpack, leaving his hands free.

Suitable for this purpose is a raincoat made entirely of synthetic plastic sheeting, such as polyethylene or polyester (Mylar), or of fabric sheeting having a plastic film laminated thereto to render it waterproof. The preferred form of raincoat is the poncho type having a hood, for then it is not necessary to take along a rainhat.

While there is room in a typical backpack bag in which to store a folded raincoat, the drawback to doing so is that the stored raincoat reduces the amount of space available for books and other articles to be carried in the backpack. Also if the backpack is heavily loaded both by a raincoat and other articles, then it may become difficult to remove the raincoat when it becomes necessary to use it.

The 1992 patent to Lieberman U.S. Pat. No. 5,165,111 discloses a backpack having a bag provided with shoulder straps, the bag having a special tubular shaped compartment in which to store a rolled up poncho. While this special compartment makes it easier to withdraw the poncho without disturbing the articles stored in the remaining portion of the bag, the load capacity of the bag is reduced by this special compartment.

SUMMARY OF INVENTION

In view of the foregoing, the main object of this invention is to provide an assembly in which a raincoat is so integrated with a backpack that the raincoat is normally in a folded state and concealed, and is only exposed when the raincoat is put to use by the wearer of the backpack.

More particularly, an object of this invention is to provide an assembly of the above type having a passive mode in which the raincoat is folded into a flat compact that is joined to the bag of the backpack and interposed between the bag and the back of the wearer, the assembly having an active mode in which the raincoat is unfolded and is donned by the wearer whereby the backpack is then carried over the raincoat.

Among the advantages of an assembly in accordance with the invention are the following:

A. Because the raincoat is external to the bag of the backpack to which it is joined, the load capacity of the bag is not reduced by the raincoat.

B. The assembly is readily convertible from the passive mode to the active mode without the need to open the bag to do so.

C. the backpack, regardless of the mode in which the assembly operates, is easily carried by the wearer.

D. The raincoat included in the assembly may be of standard, low-cost design, and need not be tailored to comply with any special requirements.

Briefly stated, these objects are attained by an integrated assembly formed by a backpack that includes a bag having a rear section to which shoulder straps are attached to form loops adapted to receive the arms of a wearer, and a raincoat having a rear panel whose upper section is joined to the front section of the bag, a separable front panel to permit the wearer to don the raincoat, and a pair of sleeves.

In the passive mode of the assembly, the raincoat is folded to form a flat compact that lies against the front section of the bag and is joined thereto, the compact then being adjacent the back of the wearer of the backpack. In the active mode of the assembly, the raincoat is unfolded so that it then depends from the front section of the bag, the sleeves of the raincoat then being extended through the loops whereby when the wearer dons the raincoat and inserts his arms through the sleeves, the backpack is then carried over the raincoat.

BRIEF DESCRIPTION OF DRAWING

For a better understanding of the invention as well as other objects and further features thereof, reference is made to the following detailed description to be read in conjunction with the accompanying drawings, wherein:

FIG. 1 is a perspective view of an integrated backpack and raincoat assembly in accordance with the invention, as it appears in the passive mode;

FIG. 2 is a side view of the assembly in the passive mode;

FIG. 3 is a separate view of the raincoat included in the assembly;

FIG. 4 shows how the rear panel of the raincoat is attached to the front section of the bag of the backpack;

DESCRIPTION OF INVENTION

Figure 5:
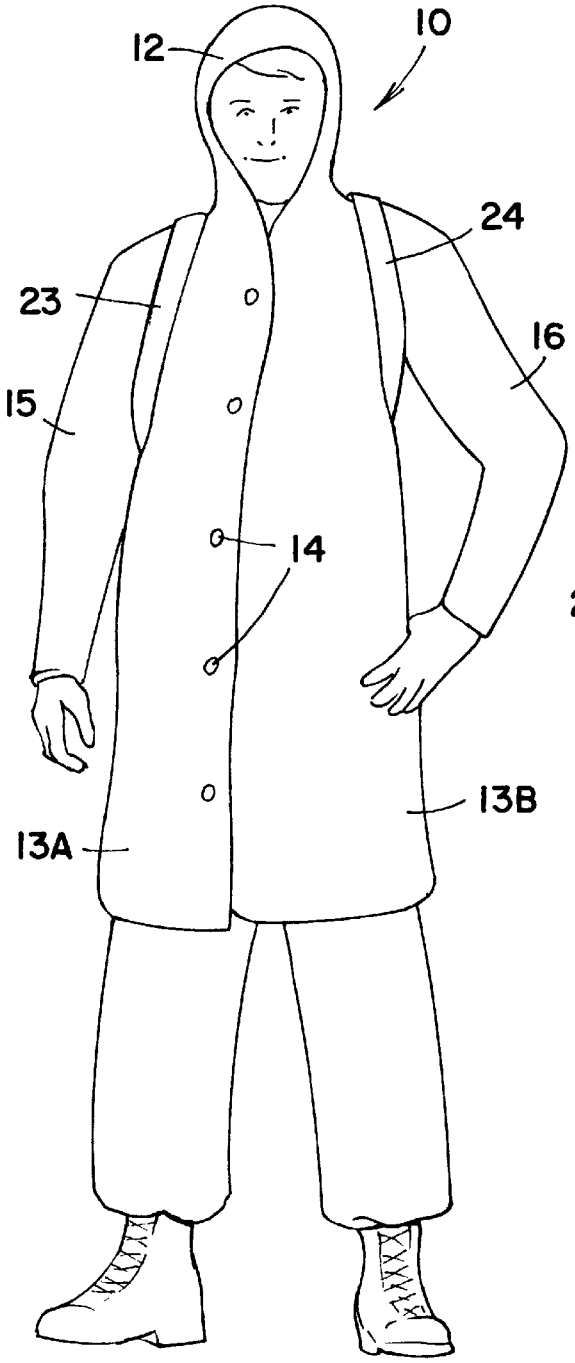
FIG. 5 is a front view of the assembly, as it appears in the active mode.
Figure 6:
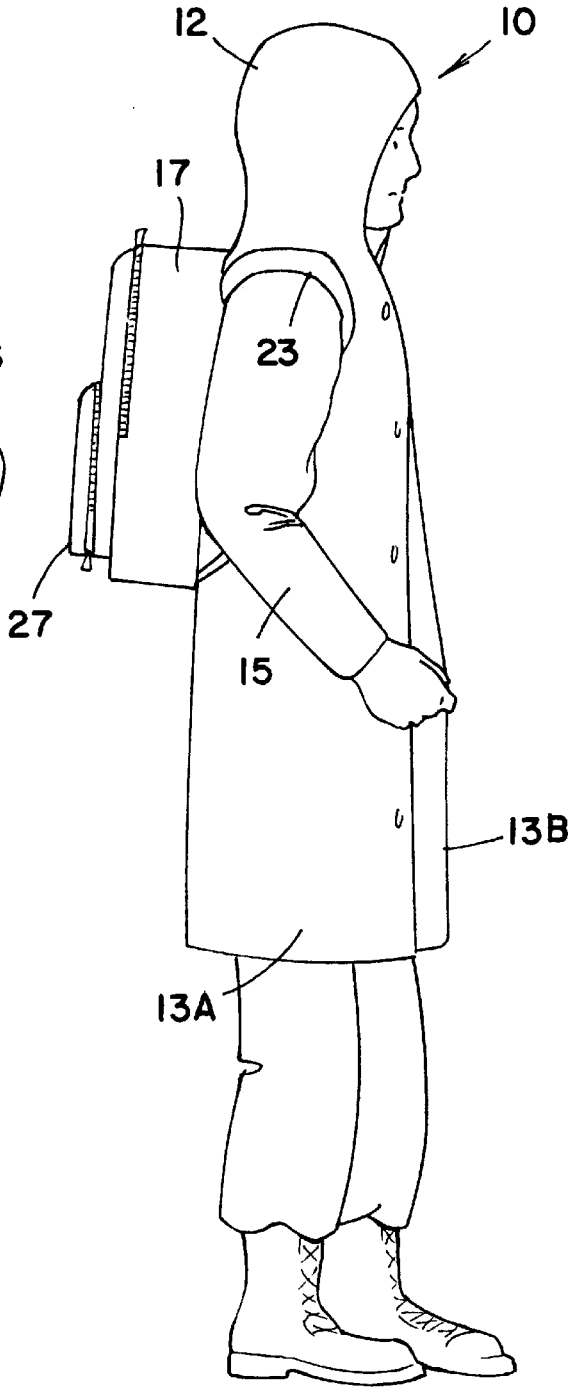
FIG. 6 is a side view of the assembly in the active mode.

The Assembly:

An integrated backpack and raincoat assembly in accordance with the invention has a passive mode, as shown in FIG. 1, in which the backpack is then strapped over the shoulders of the wearer, while the raincoat which is joined to the front section of the backpack bag is then in a flat folded state and lies against the front section so that it is adjacent the back of the wearer. This passive mode is appropriate to mild weather conditions in which a protective raincoat is unnecessary.

When the weather is inclement, the assembly is switched from its passive mode to an active mode, as shown in FIG.

5, in which the raincoat is unfolded so that it depends from the front section of the bag, whereby when the raincoat is donned by the wearer, the backpack is then strapped over the raincoat.

It is important to note that with the integrated assembly, the act of donning the raincoat serves to strap the backpack over the raincoat, and that the wearer does not as with a conventional backpack, first don a raincoat and then strap a backpack thereover.

Referring now to FIG. 3, there is shown a raincoat, generally identified by numeral 10 of a type suitable for inclusion in an integrated assembly in accordance with the invention. Raincoat 10 is preferably of the type fabricated of synthetic flexible plastic sheeting, such as polyethylene or Mylar (polyester) or a waterproof plastic-film fabric laminate.

Raincoat 10 includes a full-length rear panel 11, a hood 12 adapted to cover the head of the wearer extending upwardly from the rear panel, a separable full length front panel formed by half-sections 13A and 13B provided with snap buttons 14 to hold the section together, and a pair of sleeves 15 and 16 extending from the shoulders of the raincoat. To don this raincoat, the wearer unbuttons the half-sections of the front panel and puts his arms through sleeves 15 and 16.

A raincoat of similar design suitable for cold weather conditions may include a thin thermal insulation liner, such as THINSULATE laminated to the front or rear panels.

As shown in FIGS. 1 and 2, the backpack included in the assembly is provided with a generally rectangular bag 17 made of woven nylon fabric or other suitable material. The rear section of the bag is provided at its periphery with slide fasteners 18 and 19 affording access to the bag so that it can be loaded with books, clothing and whatever other articles are to be carried by the wearer of the backpack.

Sewn or otherwise attached to the rectangular front section 20 of bag 7 is a pair of flaps 21 and 22 which are hinged to the front section and have overlapping margins provided with a VELCRO fastener (not shown) to hold the flaps together when these are folded down.

Underlying flaps 21 and 22 is raincoat 10 which is then so folded as to form a flat compact C which is concealed by the flaps. As shown in FIGS. 3 and 4, the upper section of the rear panel of raincoat 10, as indicated by the dashed-line block B is sewn or adhesively bonded to front section 20 of the bag 17 so that the raincoat is permanently joined to the bag and cannot be separated from the assembly.

Hence when flaps 21 and 22 are folded out, and the raincoat joined to the bag is unfolded, the raincoat, as shown in FIG. 4, then depends from the front section 20 of the bag. The size of the raincoat is such as to fit almost any individual who makes use of the assembly so that it loosely fits a small individual (male or female) and just about fits much larger individuals.

Attached to opposite ends of a reinforcing strip R adjacent the upper end of front panel 20 to which a handle H is attached is a pair of fabric shoulder straps 23 and 24 which terminate in buckles 23B and 24B.

Attached to opposite sides of front section 20 at its bottom end are holding straps 25 and 26 which go into buckles 23B and 24B to form loops of adjustable size for supporting bag 17 from the shoulder of the wearer so that the bag lies against the back of the wearer. Bag 17 is provided on its rear section with an auxiliary pocket 27 having a zipper, the pocket serving to store smaller articles.

Bag 17 shown in FIGS. 1 and 2 is by way of example only, for in practice it may have a different size and shape as long as it includes a front section provided with shoulder straps to form supporting loops.

Passive Mode:

When the weather is clear and the wearer of the integrated assembly has no need of a raincoat, then the assembly is used in a passive mode in which, as shown in FIGS. 1 and 2, the raincoat is folded into a flat compact C which is joined to the front section 20 of the bag and is concealed by the folded-down flaps 21 and 22 hinged to the front section.

When therefore the wearer puts his arms through the shoulder strap loops to support the backpack on his back, the raincoat compact C is then interposed between the front section 20 of the bag to which it is joined and the back of the wearer. The raincoat in this folded state in no way interferes with the normal use of the backpack which may be loaded or unloaded by opening and closing the zippered rear section of the bag.

Active Mode:

Should the weather become inclement, making it necessary for the wearer of the backpack to don the raincoat, all he need do is to unfold flaps 21 and 22 and then unfold the raincoat compact C so that as shown in FIG. 4, the unfolded raincoat now depends from front section 20 of the bag to which it is joined.

Then the wearer extends sleeves 15 and 16 of the unfolded raincoat through the loops formed by shoulder straps 23 and 24. Then in order to don the unfolded raincoat 10, the wearer unbuttons the half sections 15A and 15B of its front panel, and inserts his arms through the sleeves 15 and 16. And since these sleeves extend through the shoulder loops of the backpack, the backpack is now carried over the shoulders of the raincoat, rather than directly over the shoulders of the wearer.

Thus in order to switch from the passive to the active mode, all the wearer must do is to take the backpack off his back, unfold the compact C stored under the flaps, place the sleeves of the unfolded raincoat through the shoulder loops, and then don the raincoat so that now the backpack is strapped over the raincoat. When the wearer wishes to switch from the active mode to the passive mode, he then takes off the raincoat and folds it to form compact C and folds down the flaps to conceal the compact.

While there has been shown a preferred embodiment of an integrated backpack and raincoat assembly in accordance with the invention, it will be appreciated that many changes and modifications may be made therein without, however, departing from the essential spirit thereof.

I claim:

1. An integrated backpack and raincoat assembly comprising:

A. a backpack including a bag provided with a front section and a pair of shoulder straps attached to the front section to form loops for supporting the bag; and B. a foldable full-length raincoat including a rear panel having an upper section joined to the front section of the bag and a lower section which when the raincoat is unfolded extends below the backpack to protect a wearer, a separable front panel to permit the wearer to don the raincoat, and a pair of sleeves, said assembly being operable in a passive mode in which the raincoat is folded to form a flat compact joined to the front section of the bag which is strapped by the loops over the shoulders of the wearer, said assembly being also operable in an active mode in which the compact is unfolded to cause the unfolded raincoat to depend from the front section of the bag and to extend below the backpack to fully protect the wearer, and the sleeves are extended through the loops whereby when the wearer dons the unfolded raincoat and inserts his arms through the sleeves, the backpack is then strapped over the raincoat, the front section of the bag being provided with a pair of hinged flaps which overlie and conceal the flat compact and are vertically hinged to fold out to permit unfolding of the raincoat so that it extends below the backpack.

2. An assembly as set forth in claim 1, in which the raincoat includes a hood for the head of the wearer extending upwardly from the rear panel.

3. An assembly as set forth in claim 2, in which the raincoat is fabricated of synthetic plastic sheeting.

4. An assembly as set forth in claim 1, in which the bag is provided with a zippered section to provide access to its interior.

5. An assembly as set forth in claim 1, in which the shoulder straps terminate in buckles and the loops are formed by a pair of holding straps that pass through the buckles to adjust the size of the loops.

6. An assembly as set forth in claim 1, in which the separable front panel of the raincoat is formed by half sections which are held together by snap buttons.

* * * * *